US008151676B2

(12) United States Patent
Shibata et al.

(10) Patent No.: US 8,151,676 B2
(45) Date of Patent: Apr. 10, 2012

(54) STRUCTURES FOR SUPPORTING SPLITTERS OF CUTTING TOOLS

(75) Inventors: Yoshinori Shibata, Anjo (JP); Koji Tanaka, Anjo (JP)

(73) Assignee: Makita Corporation, Anjo-shi (JP)

( * ) Notice: Subject to any disclaimer, the term of this patent is extended or adjusted under 35 U.S.C. 154(b) by 653 days.

(21) Appl. No.: 12/155,516

(22) Filed: Jun. 5, 2008

(65) Prior Publication Data

US 2008/0302445 A1 Dec. 11, 2008

(30) Foreign Application Priority Data

Jun. 7, 2007 (JP) ..... 2007-151441

(51) Int. Cl.
*B27B 5/06* (2006.01)

(52) U.S. Cl. ..... 83/102.1; 83/477.2; 83/478

(58) Field of Classification Search ..... 83/102.1, 83/477.2, 478, 440.2, 581, 477.1; 30/116; 144/182–184, 40

See application file for complete search history.

(56) References Cited

U.S. PATENT DOCUMENTS

| | | | | | |
|---|---|---|---|---|---|
| 1,089,223 | A * | 3/1914 | Jenkins | 83/440.2 |
| 2,496,613 | A * | 2/1950 | Woodward | 83/477.1 |
| 2,518,684 | A * | 8/1950 | Harris | 83/471.1 |
| 2,530,867 | A * | 11/1950 | Galanga | 83/102.1 |
| 7,210,386 | B1 * | 5/2007 | Chang | 83/477.2 |
| 7,437,981 | B2 * | 10/2008 | Burke et al. | 83/102.1 |
| 7,540,223 | B2 * | 6/2009 | Sasaki et al. | 83/102.1 |
| 2006/0096428 | A1 * | 5/2006 | Garcia et al. | 83/102.1 |
| 2007/0074613 | A1 * | 4/2007 | Yu | 83/581 |

FOREIGN PATENT DOCUMENTS

| | | |
|---|---|---|
| EP | 1 787 777 A2 | 5/2007 |
| JP | A-2005-262337 | 9/2005 |

* cited by examiner

*Primary Examiner* — Laura M. Lee
(74) *Attorney, Agent, or Firm* — Oliff & Berridge, PLC

(57) ABSTRACT

A support structure for a splitter of a cutting tool includes a lock device and a moving device. The lock device can lock and unlock the splitter at a storage position. The moving device can move the splitter from the storage position to an ejected position, in which a part of the splitter extends above an upper surface of a table of the cutting tool, when the lock device unlocks the splitter at the storage position.

11 Claims, 9 Drawing Sheets

STRUCTURES FOR SUPPORTING SPLITTERS OF CUTTING TOOLS

This application claims priority to Japanese patent application serial number 2007-151441, the contents of which are incorporated herein by reference.

BACKGROUND OF THE INVENTION

1. Field of the Invention

The present invention relates to structures for supporting splitters (also called "riving knives") of cutting devices, such as table saws. The splitters are positioned on the rear side of a cutting blade with respect to a cutting direction. In this specification, the term "cutting direction" is used to mean a moving direction of a workpiece during a cutting operation.

2. Description of the Related Art

Referring to FIG. 10, a known table saw 50 has a table 51 for placing a workpiece W thereon. A circular cutting blade 52 is rotatably driven by a motor 53 and is positioned such that an upper part of the cutting blade 52 protrudes upward from an upper surface of the table 51. The workpiece W can be cut by the rotating cutting blade 52 as the workpiece W is moved along the upper surface of the table 51 in a cutting direction indicated by an outline arrow in FIG. 10.

If the rotating cutting blade 52 contacts the workpiece W at its kerf that has been produced immediately after being cut by the cutting blade 52, a phenomenon called "kickback phenomenon" may be caused to force the workpiece W upward. In order to prevent this kickback phenomenon, a splitter 55 is positioned on the front side of the cutting blade 52 with respect to the cutting direction (right side as viewed in FIG. 10). The splitter 55 enters the kerf to maintain the width of the kerf to be slightly greater than the thickness of the cutting blade 52, so that the cutting blade 52 can be prevented from contacting the workpiece W at the kerf. Therefore, in general, the splitter 55 has a thin plate-like configuration with a thickness slightly smaller than the thickness of the cutting edge of the cutting blade 52 and is positioned to extend within a same plane as the cutting blade 52.

The cutting blade 52 and the motor 53 for driving the cutting blade 52 are supported on a lift 54 that is vertically movable relative to the table 51. A splitter base 56 is mounted to the lift 54 and supports the splitter 55 such that the splitter 55 extends upward from the splitter base 56. More specifically, the splitter 55 is secured to the splitter base 56 by means of two bolts 56*a*.

A cover frame 60 is mounted to the upper end of the splitter 55, which extends upward from the table 51. The cover frame 60 has a configuration elongated in the cutting direction (right and left directions as viewed in FIG. 10). Two covers 61 are vertically pivotally mounted to the front portion of the cover frame 60 with respect to the cutting direction (left portion as viewed in FIG. 10) and are positioned on opposite lateral sides of the cutting blade 52. Two kickback preventing claws 62 are vertically pivotally mounted to the rear portion of the cover frame 60 with respect to the cutting direction (right portion as viewed in FIG. 10) and are positioned on opposite lateral sides of the cutting blade 52. The covers 61 serve to prevent cutting chips, which may be produced during the cutting operation, from scattering to the surrounding environment. The kickback preventing claws 52 can contact the upper surface of a part of the workpiece W immediately after being cut by the cutting blade 52 for further reliably preventing the kickback phenomenon.

While the splitter 55 can perform the kickback preventing function during the cutting operation of the workpiece W for cutting the workpiece W into separate parts, the splitter 55 cannot perform the kickback preventing function or is unnecessary during a cutting operation for forming a flute or a groove with a predetermined width into a workpiece, because a fluting or grooving cutter has a thickness greater than a thickness of a normal cutting blade used for cutting a workpiece into separate parts. Therefore, in general, the splitter 55 is removed in the event that a fluting or grooving operation is performed.

However, because the splitter 55 is mounted to the splitter base 56 that is disposed below the table 51, it is necessary to loosen the bolts 56*a* positioned below the table 51 in order to remove the splitter 55. Therefore, the mounting and removing operations of the splitter 55 are very troublesome. In addition, there is a possibility that the splitter 55 will be lost after it is removed. In such a case, it is necessary to look for the lost splitter in order to remount the splitter.

For the above reason, Japanese Laid-Open Patent Publication No. 2005-262337 has proposed to enable a splitter to move downwardly relative to the table away from the front position of a cutting blade when the splitter is not needed.

However, with the configuration of the above publication, a part of the splitter still extends upward from the upper surface of the table even if the splitter has moved downward.

Therefore, there has been a need for a support structure for a splitter which enables the splitter to be easily ejected from a position where substantially no part of the splitter extends upward from the upper surface of a table.

SUMMARY OF THE INVENTION

One aspect according to the present invention includes a support structure for a splitter of a cutting tool includes a lock device and a moving device. The lock device can lock and unlock the splitter at a storage position. The moving device can move the splitter from the storage position to an ejected position, in which a part of the splitter extends above an upper surface of a table of the cutting tool, when the lock device unlocks the splitter at the storage position. Therefore, the splitter can move to the ejected position in a pop-up manner.

DETAILED DESCRIPTION OF THE INVENTION

Figure 1:
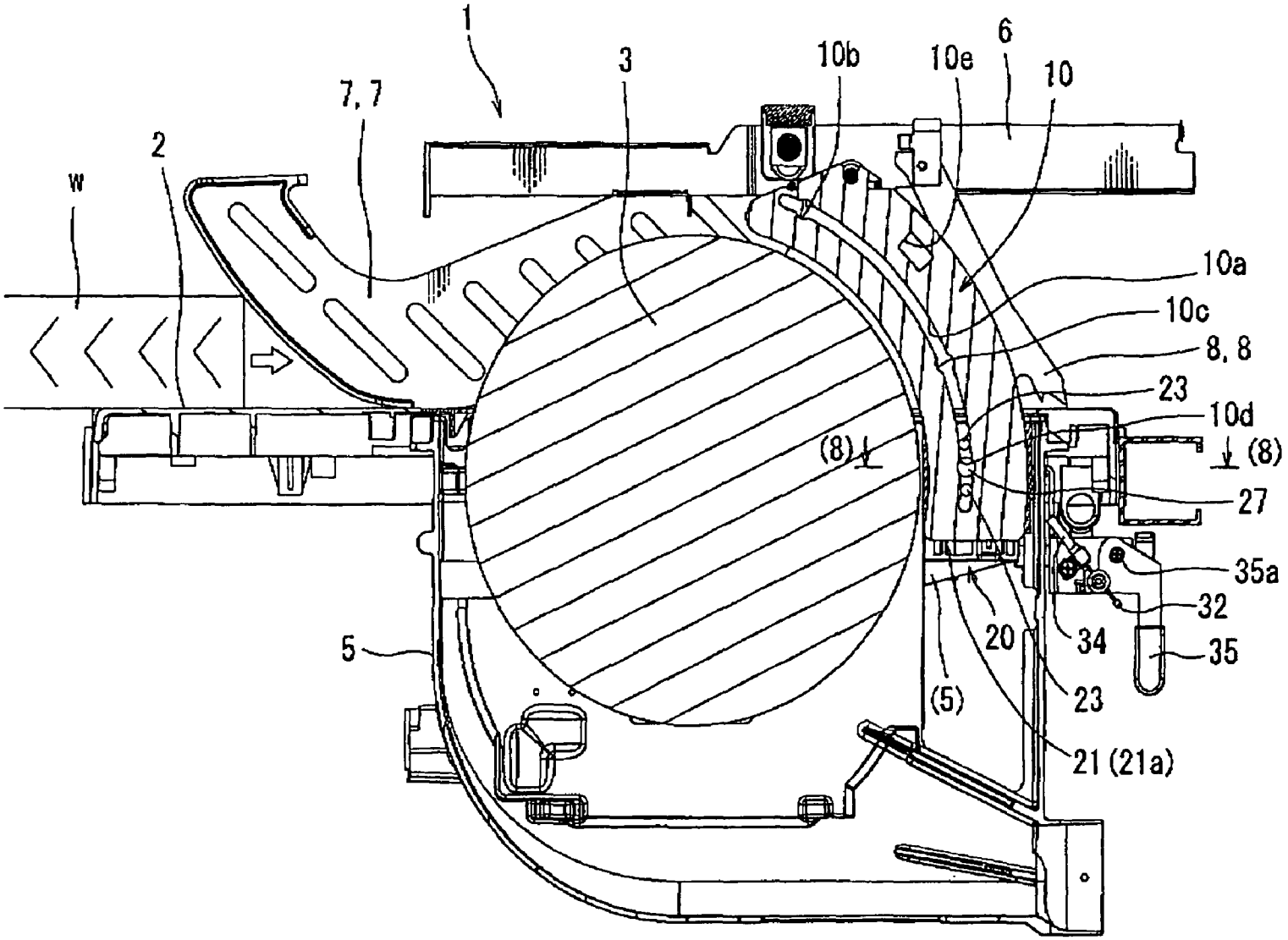
FIG. 1 is a side view of a table saw incorporating a support structure for supporting a splitter according to an embodiment of the present invention and showing the state where the splitter has been fixed in an operational position.

Each of the additional features and teachings disclosed above and below may be utilized separately or in conjunction with other features and teachings to provide improved support structures for splitters and cutting tools having such support structures. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a support structure for a splitter of a cutting tool includes a guide device, a lock device and an ejecting device. The guide device permits the movement of the splitter between an operational position and a storage position. The lock device can lock and unlock the splitter at either of the operational position and the storage position. At least a part of the splitter extends upward from and upper surface of the table when the splitter is in the operational position. On the other hand, the entire splitter is positioned below the upper surface of the table when the splitter is in the storage position. The ejecting device can move the splitter from the storage position to an ejected position between the operational position and the storage position.

With this arrangement, even during a fluting or grooving operation, it is not necessary to remove the splitter, because the splitter can be positioned and locked at the storage position. Therefore, there is no need for troublesome removing and remounting operations of the splitter.

In addition, the splitter can move from the storage position to the ejected position by the ejecting device, so that an operator can easily move the splitter from the ejected position to the operational position by holding the splitter with fingers.

The ejecting device may include an operation lever for a remote operation of the splitter for movement from the storage position to the operational position. With this arrangement, the operator can easily operate the ejecting device by using the operation lever. For example, by positioning the operation lever on the lateral side of the table, it is not necessary for the operator to look into the region below the table in a cramped posture.

The ejecting device may include an engaging member constructed to engage the splitter during the movement of the splitter from the operational position to the storage position in order to apply a biasing force to the splitter for the movement from the storage position to the ejected position. With this arrangement, it is possible to move the splitter from the storage position to the ejected position in a pop-up manner.

An embodiment of the present invention will now be described with reference to FIGS. 1 to 9. Referring to FIG. 1, a cutting tool 1 configured as a table saw is shown incorporating a support structure for supporting a splitter 10 according to the embodiment. The cutting tool 1 generally includes a table 2 and a circular saw blade or a cutting blade 3. The table 2 defines an upper surface on which a workpiece W can be placed. The cutting blade 3 is positioned such that an upper part of the cutting blade 3 protrudes upward from the table 2. The cutting blade 3 and a motor (not shown) are supported on a lift 5. The cutting blade 3 is coupled to the motor via a speed reduction mechanism (not shown), so that the cutting blade 3 can be rotatably driven. The upwardly protruding amount of the cutting blade 3 from the upper surface of the table 2 can be adjusted by changing the vertical position of the lift 5, so that the cutting depth of the cutting blade 3 into the workpiece W can be adjusted.

As shown in FIG. 1, the workpiece W is cut by the cutting blade 3 as the workpiece W is moved from the left side to the right side. Therefore, in this embodiment, the right direction indicated by an outline arrow in FIG. 1 corresponds to a cutting direction.

The splitter 10 is disposed on the front side of the cutting blade 3 with respect to the cutting direction. The splitter 10 has a flat plate-like configuration and has a thickness that is substantially the same as the thickness of the cutting blade 3. The lower portion of the splitter 10 is supported on a splitter base 20 mounted on the lift 5, so that an upper portion of the splitter 10 extends upward from the upper surface of the table 2. The support structure of the splitter 10 on the splitter base 20 will be explained later.

Figure 2:
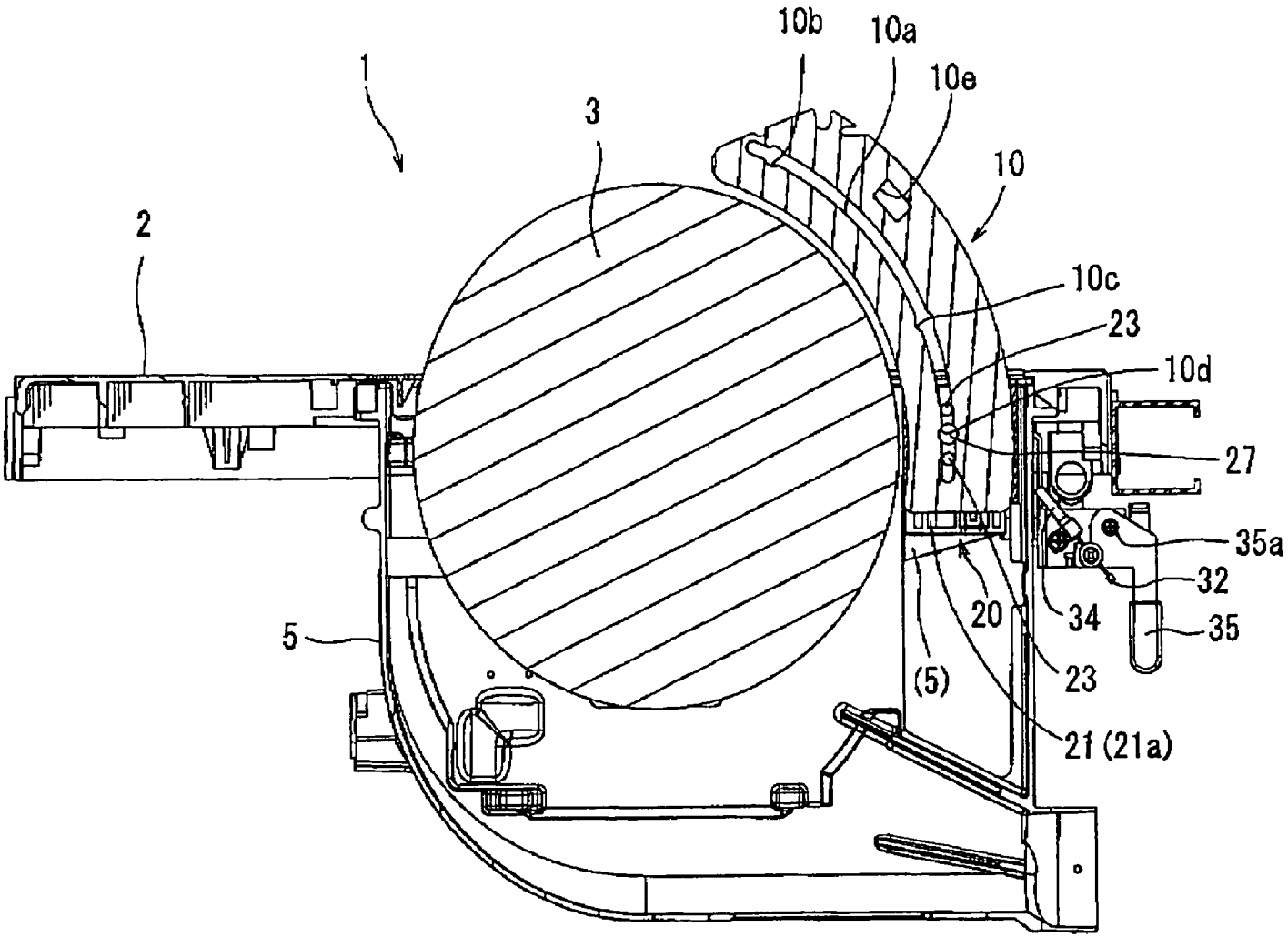
FIG. 2 is a view similar to FIG. 1 but showing the table saw with covers and kickback preventing claws removed.
Figure 3:
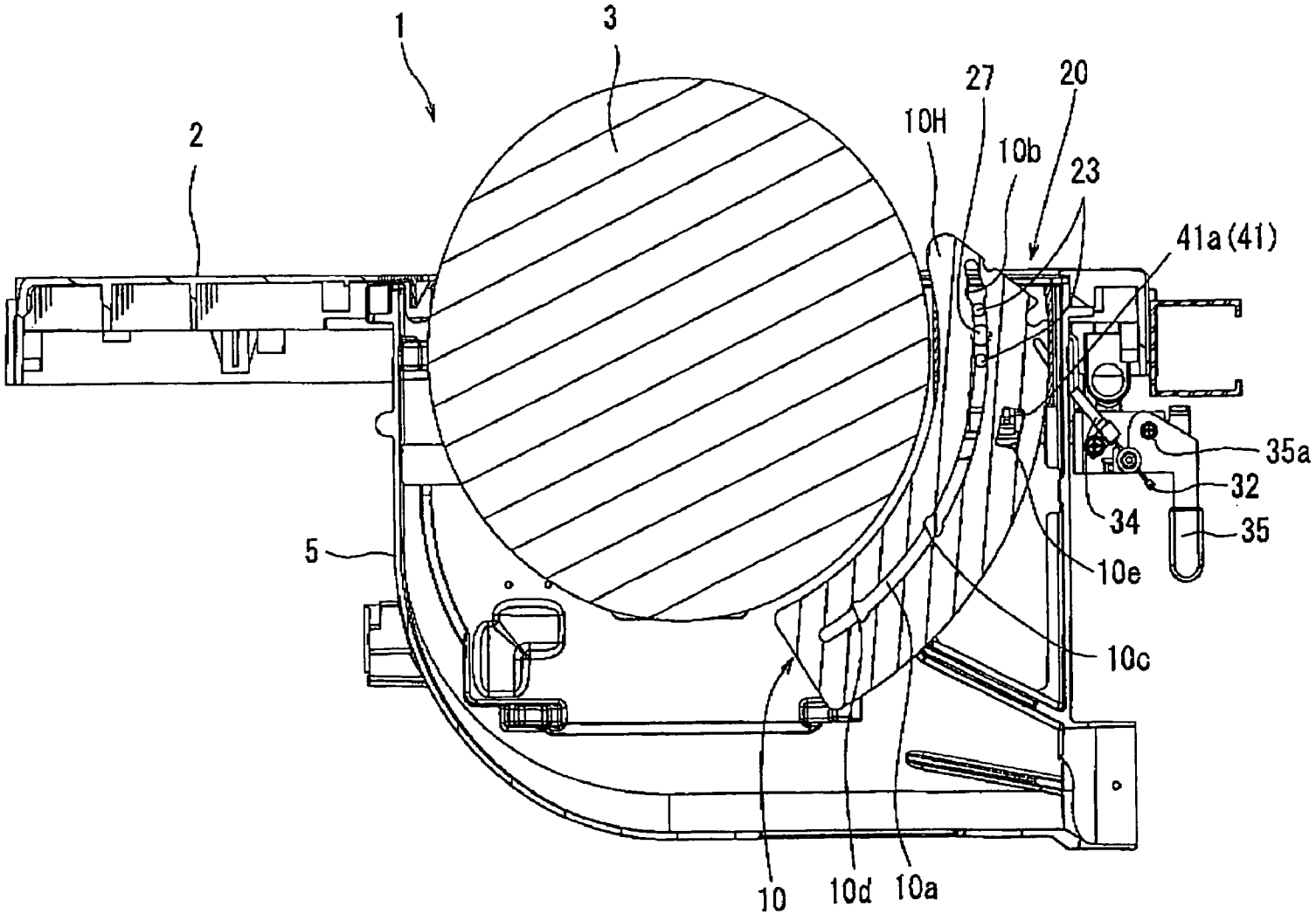
FIG. 3 is a view similar to FIG. 2 but showing the state where the splitter has been moved to an ejected position.
Figure 4:
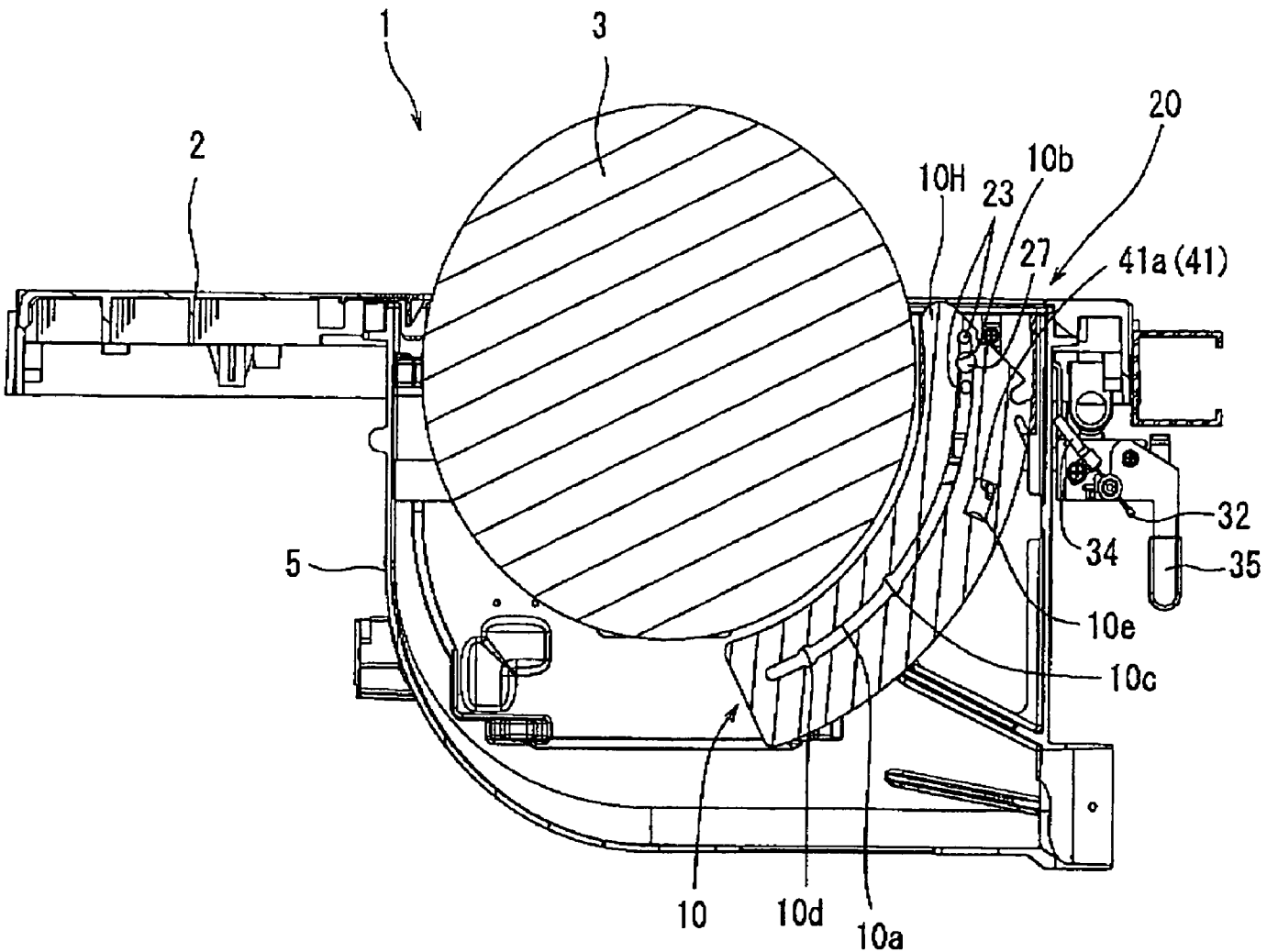
FIG. 4 is a view similar to FIG. 2 but showing the state where the splitter has been fixed in a storage position.

A frame 6 having a longitudinal axis is removably mounted to the upper portion of the splitter 10. In the mounted position, the longitudinal axis of the frame 6 extends substantially parallel to the cutting direction. A pair of covers 7 and a pair of kickback preventing claws 8 are supported on the frame 6. More specifically, the covers 7 are vertically pivotally supported on the frame 6, so that the front portion of each cover 7 contacts the upper surface of the table 2 by the gravity force. The covers 7 serve to cover the cutting blade 3 from opposite lateral sides for preventing cutting chips, which may be produced during the cutting operation, from scattering to the environment. Also, the kickback preventing claws 8 are vertically pivotally supported on the frame 6 in such a manner that the kickback preventing claws 8 are suspended downward from the frame 6. During the cutting operation, the kickback preventing claws 8 can hold the workpiece W against the table 2 in order to inhibit the kickback phenomenon. FIGS. 2 to 4 show the state where the covers 7 and the kickback preventing claws 8 have been removed from the splitter 10.

The splitter 10 has a configuration curved in an arc shape along the rear side of the cutting blade 3 with respect to the cutting direction. The splitter 10 can move between a first operational position shown in FIG. 1 and a storage position shown in FIG. 4 along an arc-shaped path that corresponds to the outer circumference of the cutting blade 3.

A guide slot 10*a* is formed in the splitter 10 and extends along a substantially central line with respect to the width of the splitter 10, so that the guide slot 10*a* has an arc-shaped configuration about the rotational axis of the cutting blade 3. The guide slot 10*a* has opposite ends positioned proximally to opposite ends in the circumferential direction of the splitter 10. Three circular lock holes 10*b*, 10*c* and 10*d* are each formed in continuity with the guide slot 10*a* and have the same diameter with each other. The circular lock hole 10*b* is positioned at substantially the central position of the guide slot 10*a*. The circular lock holes 10*c* and 10*d* are positioned proximal to the opposite ends of the guide slot 10*a*, respectively.

As shown in FIG. 4, the lock hole 10*b* positioned on the upper side as viewed in FIG. 4 is used for locking the splitter 10 at the storage position. The lock holes 10*c* and 10*d* positioned on the central side and the lower side, respectively, are used for locking the splitter 10 at a first operative position and a second operative position, respectively. The first operative position and the second operative position provide a first protruding amount and a second protruding amount of the splitter 10 from the table 2.

Figure 8:
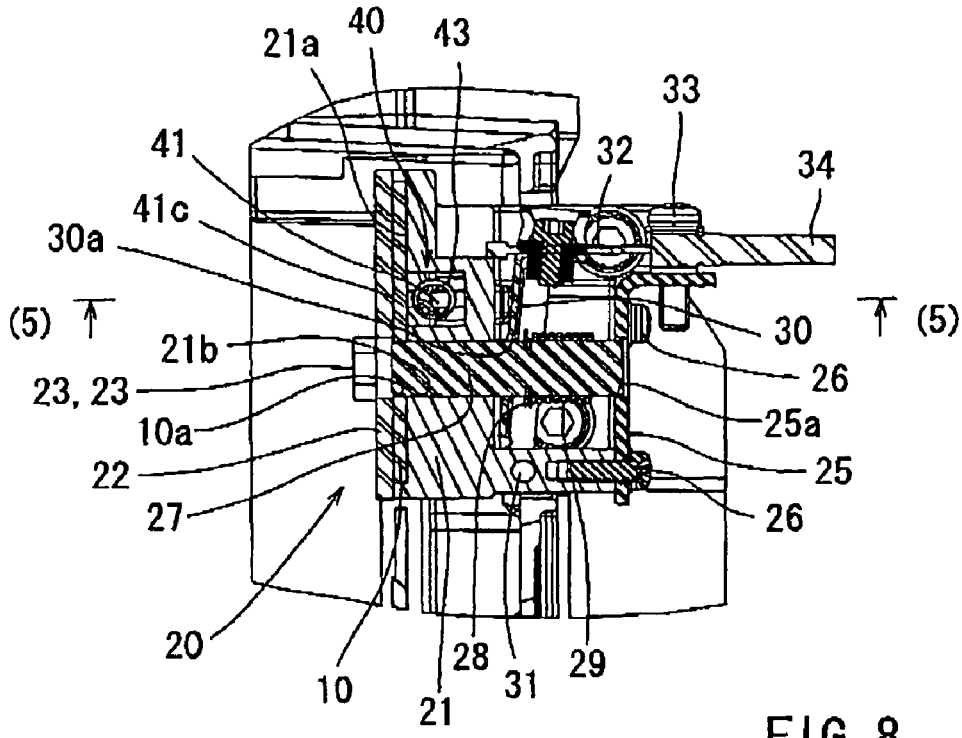
FIG. 8 is a cross sectional view taken along line (8)-(8) in FIG. 1 and showing a horizontal sectional view of a support base of the splitter with the splitter fixed in position by a lock pin.
Figure 9:
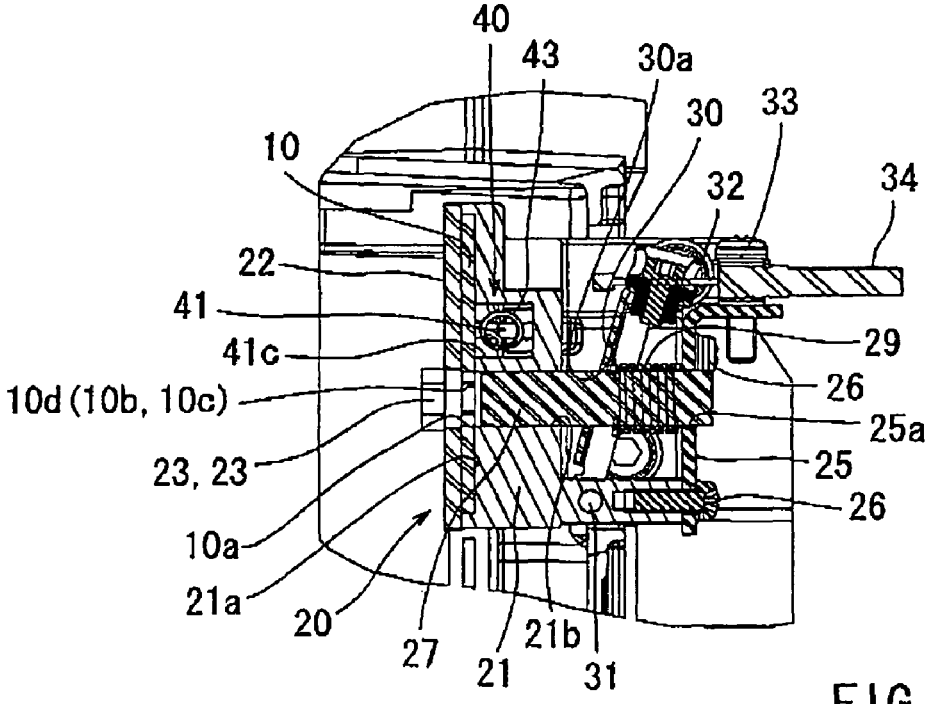
FIG. 9 is a view similar to FIG. 8 but showing the state where the lock pin has been moved to an unlock position for permitting the movement of the splitter.
Figure 10:
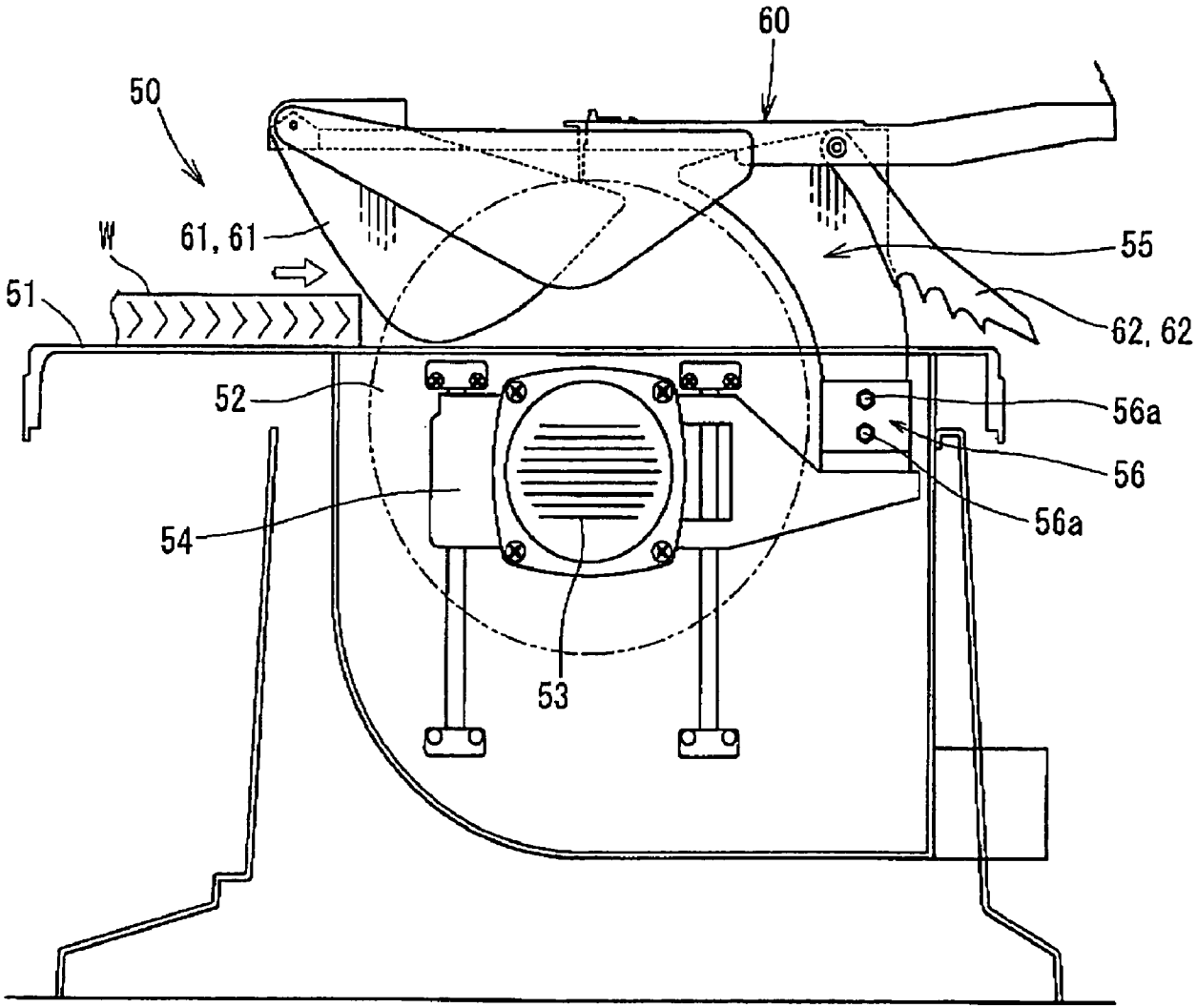
FIG. 10 PRIOR ART
FIG. 10 is side view of a known table saw having a splitter support structure.

The details of the splitter base 20 are shown in FIGS. 8 and 9. The splitter base 20 includes a base body 21 and a support plate 22. The base body 21 is mounted to the lift 5. The support plate 22 is secured to the base body 21. A guide slot 21*a* is formed in the base body 21 and is sized to receive the splitter 10 without allowing substantial movement of the splitter 10 in the widthwise direction. The guide slot 21*a* extends throughout the base body 21 in the vertical direction, so that the splitter 10 can move within the guide slot 21*a* along the longitudinal direction of the splitter 10.

The support plate 22 serves to close the guide slot 21*a* from the lateral side and is secured to the base body 21 by means of two bolts 23. The bolts 23 are inserted into the support plate 22 so as to extend across the guide slot 10*a* of the splitter 10 and are tightened into the base body 21. Therefore, the bolts 23 move along the guide slot 10*a* as the splitter 10 is moved between the operative position and the storage position. In other words, the splitter 10 can move in the vertical direction within a movable range of the bolts 23 relative to the guide slot 10*a*. In this way, the bolts 23 serve to prevent the splitter 10 from being removed from the guide slot 21*a*.

A retainer plate 25 is secured to the rear surface (right surface as viewed in FIGS. 8 and 9) of the base body 21 by means of screws 26, so that the retainer plate 25 extends substantially parallel to the widthwise direction of the guide slot 21*a*. A lock pin 27 is received within a retaining hole 25*a* formed in the retainer plate 25 and also within a retaining hole 21*b* formed in the base body 21, such that the lock pin 27 can move in an axial direction (left or right direction as viewed in FIGS. 8 and 9).

More specifically, the lock pin 27 can move between a lock position, where a front end (left end as viewed in FIGS. 8 and 9) of the lock pin 27 protrudes into the guide slot 21*a*, and an unlock position, where the front end of the lock pin 27 is retreated from the guide slot 21*a*.

The lock pin 27 has a diameter that is larger than the width of the guide slot 10*a* but is slightly smaller than the diameter of the lock holes 10*b*, 10*c* and 10*d*. Therefore, although the lock pin 27 cannot be inserted into the guide slot 10*a*, it can be inserted into any of the lock holes 10*b*, 10*c* and 10*d*. When the lock pin 27 is in the lock position and is inserted into the lock hole 10*b*, the splitter 10 can be fixed in the storage position. When the lock pin 27 is in the lock position and is inserted into the lock hole 10*d*, the splitter 10 can be fixed in the first operational position.

As shown in FIGS. 1 and 2, when the splitter 10 is in the first operational position, the upper end of the splitter 10 can be positioned at a higher level than the cutting blade 3. With this position, the front end of the lock pin 27 can be inserted into the lock hole 10*d*, so that the splitter 10 can be fixed in the first operational position.

On the other hand, as shown in FIG. 4, when the splitter 10 is in the storage position, the upper end of the splitter 10 does not extend above the upper surface of the table 2. With this position, the front end of the lock pin 27 can be inserted into the lock hole 10*b*, so that the splitter 10 can be fixed in the storage position.

When the splitter 10 is in the second operational position, the splitter 10 is positioned at an intermediate position between the first operational position and the storage position. With this position, the front end of the lock pin 27 can be inserted into the lock hole 10*c*, so that the splitter 10 can be fixed in the second operational position.

An ejecting device 40 is provided on the support base 20 for the movement of the splitter 10 from the storage position to an ejected position when the splitter 10 is locked at the storage position. In the ejected position, a grip portion 10H formed on the upper end of the splitter 10 extends above the upper surface of the table 2. The ejecting device 40 will now be described in detail.

A stop ring 28 is secured to the lock pin 27 at a substantially middle position in the axial direction of the lock pin 27. A compression spring 29 is fitted around the lock pin 27 so as to be interleaved between the stop ring 28 and the retainer plate 25. An actuation plate 30 is pivotally mounted to the base body 21 via a support pin 31. An insertion hole 30*a* is formed in the actuation plate 30 and is sized to permit insertion of the lock pin 27 but to prevent passage of the stop ring 28. The actuation plate 30 is positioned on the side opposite to the compression spring 29 with respect to the stop ring 28.

Therefore, as the actuation plate 30 pivots rearward (rightward as viewed in FIGS. 8 and 9) about the support pin 31, the actuation plate 30 can abut to the stop ring 28 to move the lock pin 27 toward the unlock position against the biasing force of the compression spring 29. On the other hand, as the actuation plate 30 pivots forward (leftward as viewed in FIGS. 8 and 9), the lock pin 27 is forced to return towards the lock position by the biasing force of the compression spring 29. In this way, the lock pin 27 is biased in a direction towards the lock position by the compression spring 29. FIG. 8 shows the state where the lock pin 27 has moved to the lock position, so that the front end of the lock pin 27 is inserted into the lock hole 10*b* (or 10*c* or 10*d*) to lock the position of the splitter 10. FIG. 9 shows the state where the lock pin 27 has been moved to the unlock position, so that the front end of the lock pin 27 is removed from the lock hole 10*b* (or 10*c* or 10*d*) to unlock the splitter 10 so as to enable the movement of the splitter 10.

One end of an actuation wire 32 is connected to a pivotal end of the actuation plate 32. A portion on the side of the one end of the actuation wire 32 is inserted into a retainer tube 34 secured to the retainer plate 26 by means of a screw 33. As shown in FIG. 1, the actuation wire 32 is drawn from a position below the table 2 to a position proximal to the lateral side of the table 2 under the guide of the retainer tube 34. The other end of the actuation wire 32 is connected to an operation lever 35 that is pivotally mounted to the lateral side of the table 2 via a support pin 35*a*. Therefore, as the operation lever 35 is pivoted in a counterclockwise direction (unlock direction) as viewed in FIG. 1, the actuation wire 32 is pulled to pivot the actuation plate 30 towards the unlock position, so that the lock pin 27 moves towards the unlock position for permitting the movement of the splitter 10.

The operation for pivoting the operation lever 35 in the unlock direction is performed against the biasing force of the compression spring 29, which is indirectly applied to the operation lever 35 via the actuation wire 32 and the actuation plate 30. Therefore, when the operation for pivoting the operation lever 35 in the unlock direction is released, the operation lever 35 returns in a lock direction (clockwise direction as viewed in FIG. 1) by the biasing force of the compression spring 29. Hence, the actuation wire 32 is pulled leftward as viewed in FIG. 8, so that the actuation plate 30 pivots in the counterclockwise direction about the support pin 31. As a result, the lock pin 27 moves in the lock direction by the biasing force of the compression spring 29.

Because the operation lever 35 is positioned on the lateral side of the table 2, an operator can easily operate the operation lever 35 in the unlock direction to enable the movement of the splitter 10, while the operator is positioned remote from the lock pin 27. Therefore, troublesome operations, such as an operation for loosening fixing bolts or the like, while the operator looks into the region below the table 2 in a cramped posture, are no longer necessary.

The ejecting device 40 includes an engaging member 41 that can engage the splitter 10 to force it towards the ejected position when the splitter 10 is moved towards the storage position. As shown in FIGS. 8 and 9, a vertical guide recess 41*c* is formed in the base body 21 for vertically movably receiving the engaging member 41. The engaging member 41 is biased in an upward direction (in a front direction with respect to the sheet of FIG. 8 or FIG. 9) by a tension spring 43. The upper end of the tension spring 43 is in engagement with a screw 44 attached to the upper portion of the base body 21. The lower end of the tension spring 43 is in engagement with an engaging hole 42 formed in the upper portion of the engaging member 41.

A hook portion 41*a* is formed on the lower portion of the engaging member 41, so that the hook portion 41*a* can protrude into and retreat from the guide slot 21*a* as the engaging member 41 pivots in one direction and an opposite direction, respectively, as will be explained later. A leaf spring 45 is disposed on the backside (right side as viewed in FIGS. 5 to 7) of the engaging member 41 and biases the engaging member 41 in such a direction that the hook portion 41*a* protrudes into the guide slot 21*a*.

Figure 5:
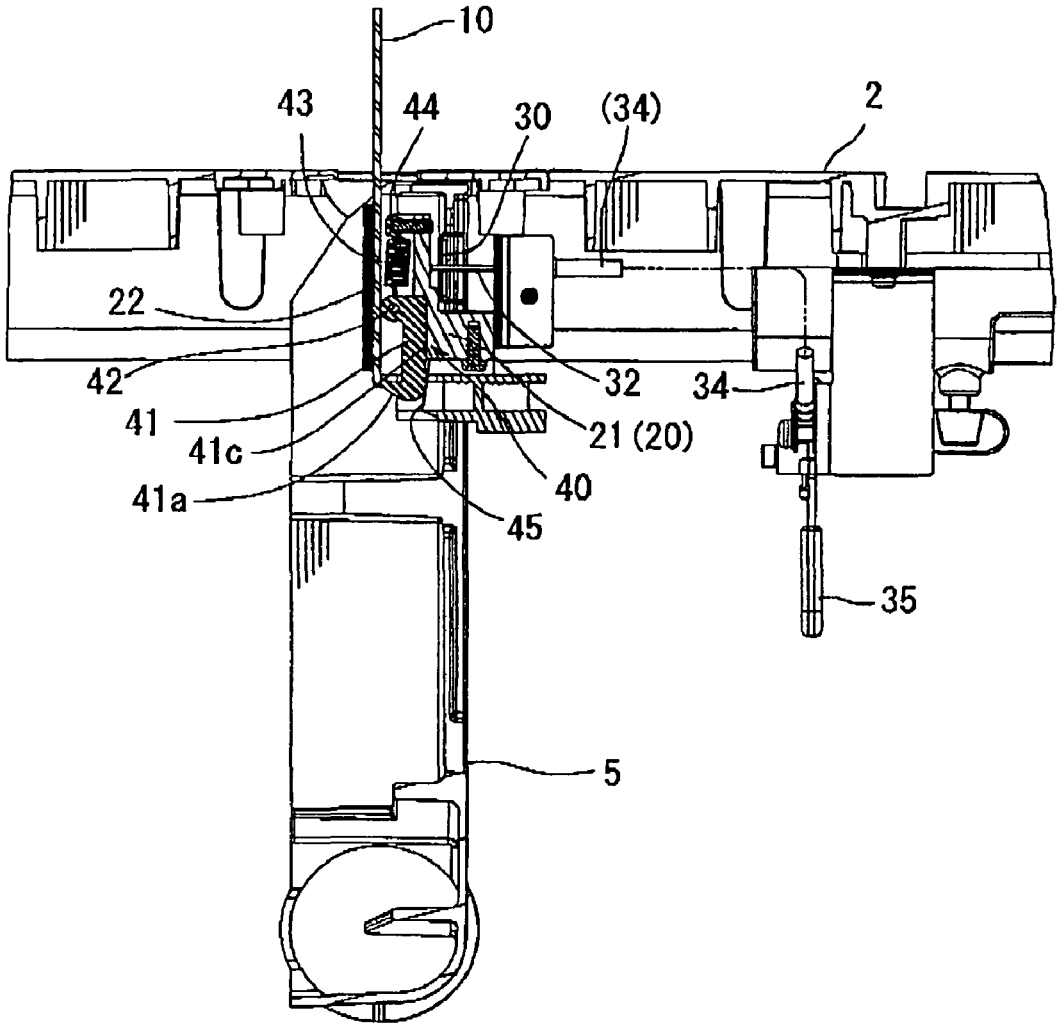
FIG. 5 is a cross sectional view taken along line (5)-(5) in FIG. 8 and showing a vertical sectional view of an ejecting device with the splitter positioned in an operational position.
Figure 6:
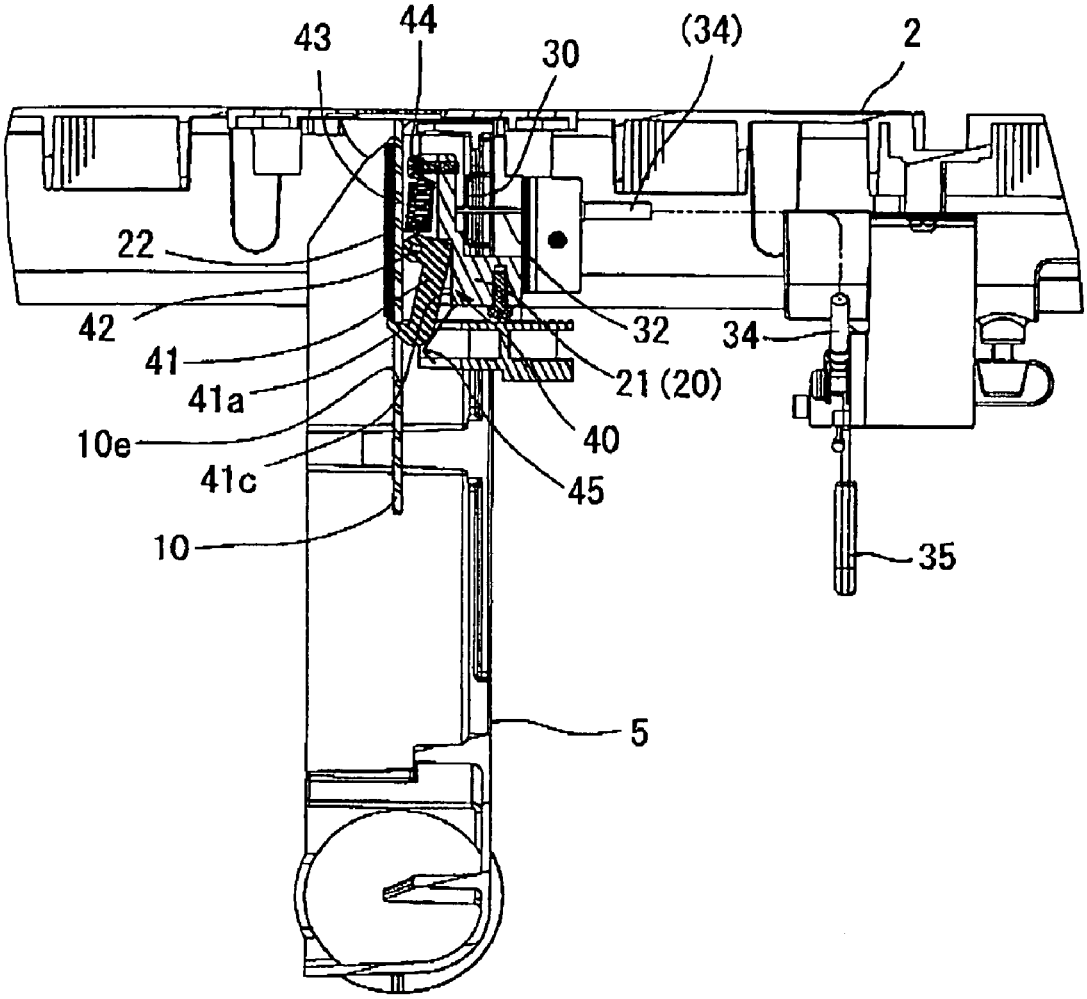
FIG. 6 is a view similar to FIG. 5 but showing the state where the splitter is positioned at an ejected position and an engaging member is in engagement with an engaging hole formed in the splitter.
Figure 7:
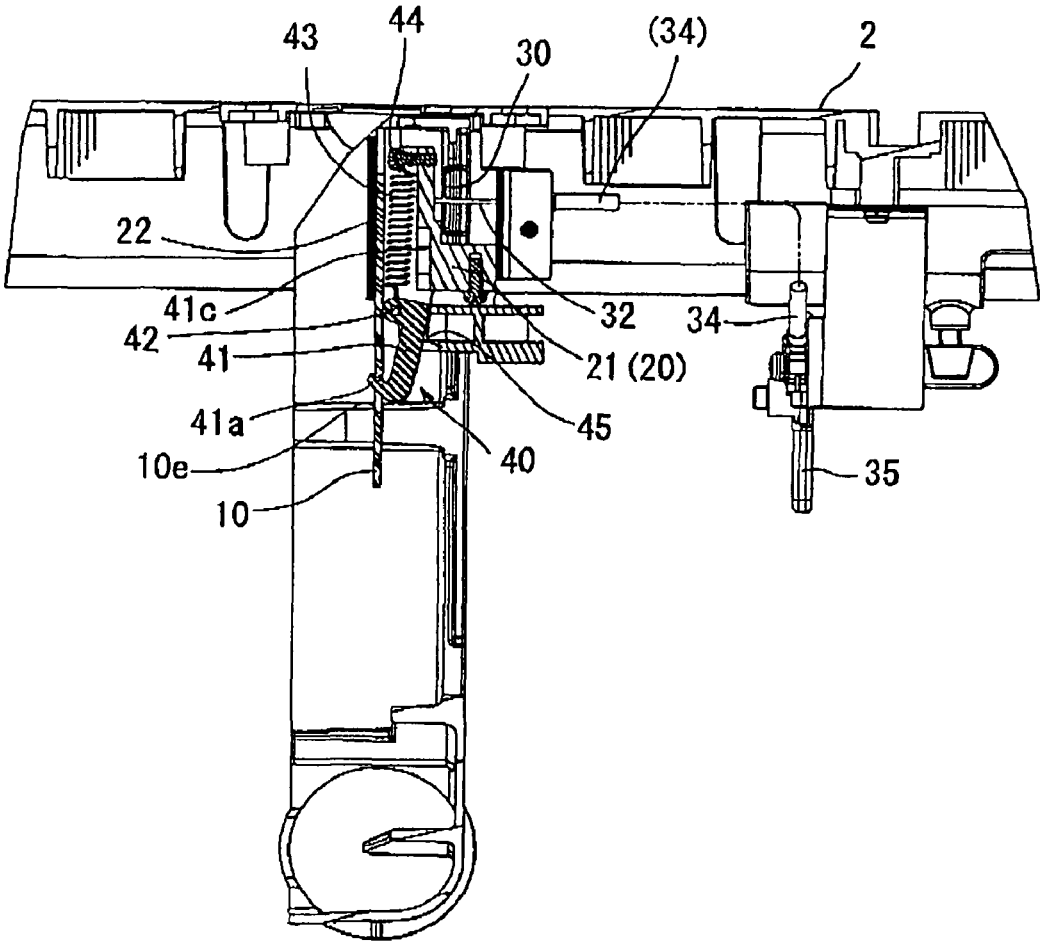
FIG. 7 is a view similar to FIG. 5 but showing the state where the splitter is positioned at the storage position.

As shown in FIGS. 1 to 4, a rectangular engaging hole 10*e* is formed in the splitter 10 separately from the guide slot 10*a* and is positioned on an upper side of the central portion with respect to the longitudinal direction of the splitter 10. Therefore, when the splitter 10 has been moved to the first operational position as shown in FIG. 5 or the second operational position (not shown), the hook portion 41*a* of the engaging member 41 is pressed against a side surface of the splitter 10 by the biasing force of the leaf spring 45. In the state shown in FIG. 5, the engaging member 41 is held within the upper portion of the guide recess 41*c* by the tension spring 43.

As the splitter 10 is moved downward from the first or second operational position in the state where the lock pin 27 has been moved to the unlock position by the operation of the operation lever 35, the hook portion 41*a* of the engaging member 41 moves upward while the hook portion 41*a* slides along the side surface of the splitter 10. When the splitter 10 has moved to the ejected position shown in FIG. 3, the hook portion 41*a* of the engaging member 41 protrudes into the engaging hole 10*e* by the biasing force of the leaf spring 45. At the same time, the hook portion 41*a* of the engaging member 41 engages the upper edge of the engaging hole 10*e*.

As the splitter 10 is moved further downward in the state where the hook portion 41*a* is in engagement with the engaging hole 10*e*, the engaging member 41 moves downward together with the splitter 10 against the biasing force of the tension spring 43. In this way, the movement of the splitter 10 from the ejected position (the position shown in FIG. 3) to the storage position (the position shown in FIG. 4) is performed against the biasing force of the tension spring 43. When the operation lever 35 is released while it is positioned at the unlock position after the splitter 10 has moved to the storage position, the lock pin 27 is inserted into the lock hole 10*b* by the biasing force of the compression spring 29, so that the splitter 10 can be fixed in the storage position. When in the storage position, the entire splitter 10 is positioned below the table 2 and the upper portion of the splitter 10 does not extend from the upper surface of the table 2.

In the state where the splitter 10 has been fixed in the storage position by the lock pin 27, the biasing force of the tension spring 43 is still applied to the splitter 10. In other word, the biasing force is applied to the splitter 10 in the direction toward the ejected position (upward direction). Therefore, when the operation lever 35 is operated to move the lock pin 27 toward the unlock position against the biasing force of the compression spring 29, the splitter 10 is moved from the storage position to the ejected position by the biasing force of the tension spring 43.

As the splitter 10 returns to the ejected position by the biasing force of the tension spring 43, the upper grip portion 10H of the splitter 10 extends upward from the upper surface of the table 2. Therefore, the operator can easily withdraw the splitter 10 to the first or second operational position by holding the upper grip portion 10H with fingers. As the operator withdraws the splitter 10 from the ejected position to the first or second operational position, the lower edge of the engaging hole 10*e* engages the lower end of the hook portion 41*a*. Then, due to the force applied by the lower edge of the engaging hole 10*c* to the hook portion 41*a*, the engaging member 41 pivots in such a direction that the hook portion 41*a* is removed from the engaging hole 10*e*. After having removed from the engaging hole 10*e*, the hook portion 41*a* slidably contacts the side surface of the splitter 10.

When the operation lever 35 is released while it is positioned at the unlock position after the splitter 10 has moved to the first or second operational position, the lock pin 27 is inserted into the lock hole 10*d* or 10*e* by the biasing force of the compression spring 29. Therefore, the splitter 10 can be fixed in the first or second operational position. After the splitter 10 has been fixed in the first or second operational position in this way, the frame 6 may be attached to the upper end of the splitter 10, so that the covers 7 (as well as the kickback preventing claws 8) can be positioned on opposite sides in a direction transverse to the cutting direction. The cutting operation can then be performed.

As described above, according to the support structure for the splitter 10 of this embodiment, the splitter 10 can move between the first or second operational position and the storage position. When the splitter 10 has moved to the storage position, no part of the splitter 10 extends upward from the upper surface of the table 2. Therefore, it is not necessary to remove the splitter 10 from the support base 20 even in the case that the splitter 10 should be moved away from the front side of the cutting blade 3, for example, for fluting or grooving a workpiece. Hence, there is no trouble in operation for removing the splitter 10 from the support base 20 and for remounting the splitter 10 to the support base 20. As a result, the operation efficiency can be improved. In addition, there is no risk of loss of the splitter or loss of time looking for the splitter.

The support structure includes the ejecting device 40 that enables the splitter 10 to be ejected from the storage position to the ejected position. With this ejecting device 40, when the lock pin 27 is moved from the lock position to the unlock position by the remote operation of the operation lever 35, the splitter 10 in the storage position can automatically move to the ejected position by the biasing force of the tension spring 43. In the ejected position, the grip portion 10H at the upper portion of the splitter 10 extends upward from the upper surface of the table 2. Thus, the splitter 10 extends upward from the upper surface of the table 2 in a pop-up manner. The operator can then easily move the splitter 10 to the first or second operational position by holding the grip portion 10H with fingers and withdrawing the splitter 10 upward.

In addition, the movement of the lock pin 27 for fixing the splitter 10 in position relative to the support base 20 can be caused by the operation of the operation lever 35 that is disposed on the lateral side of the table 2. Therefore, in order to operate the lock pin 20, a cramped posture is not needed to look into the region below the table 2 in a cramped posture. The operator can perform operations for locking and unlocking the splitter 10 in a comfortable posture. As a result, the operation for locking and unlocking the splitter 10 can be easily rapidly performed.

Further, with the ejecting device 40 of the above embodiment, the biasing force for moving the splitter 10 toward the ejected position can be given by the movement of the engaging member 41 against the biasing force of the tension spring 43 following the engagement of the hook portion 41*a* of the engaging member 41 during the process of movement of the splitter 10 toward the storage position. Therefore, the pop-up function can be realized by a simple mechanism only.

The above embodiment can be modified in various ways. For example, although the splitter 10 has the lock holes 10*c* and 10*d* for two different operational positions in addition to the lock hole 10*b* for the storage position, the lock hole 10*c* positioned on the upper side can be omitted, so that only the lock hole 10*d* can be used for the operational position. Alternatively, the splitter 10 may have three or more lock holes for different operational positions.

Although the movement of the lock pin 27 towards the unlock position is achieved by a remote operation device including the operation lever 35, such movement can be achieved by the direct operation of the lock pin 27 by fingers of the operator. In the case of the direct operation of the lock pin 27, the operation lever 35 and its associated elements, such as the actuation plate 30, the compression spring 29 and the actuation wire 32 can be omitted.

Although the biasing force for moving the splitter 10 toward the ejected position is given by the movement of the engaging member 41 against the biasing force of the tension spring 43 following the engagement of the hook portion 41*a* of the engaging member 41, such a biasing force can be realized by various other configurations. For example, a spring-biased plate may be positioned below the moving path of the splitter for applying an upward biasing force to the splitter when the splitter has contacted the spring-biased plate upon movement to the storage position. One skilled in the art can envisage various other mechanisms for providing a pop-up function.

Furthermore, although the operation lever 35 is positioned on the lateral side of the table 2, the operation lever 35 may be positioned at any other positions. For example, the operation lever 35 may be disposed on the upper surface of the table 2.

This invention claims:

1. A support structure for a splitter of a cutting tool having a table, comprising:

a guide device constructed to permit movement of the splitter between an operational position and a storage position;

a lock device constructed to lock and unlock the splitter at either of the operational position and the storage position, at least a part of the splitter extending upward from an upper surface of the table when the splitter is in the operational position, and the entire splitter being positioned below the upper surface of the table when the splitter is in the storage position; and an ejecting device constructed to automatically move the splitter from the storage position to an ejected position between the operational position and the storage position upon unlocking of the splitter at the storage position, the ejecting device including an engaging member and a biasing device coupled to the engaging member, wherein:

as the splitter is moved from the operational position toward the storage position, the engaging member engages the splitter when the splitter reaches the ejected position, and the engaging member maintains engagement of the splitter until the splitter reaches the storage position; and the biasing device accumulates the movement force of the splitter from the ejected position to the storage position as a biasing force in a direction opposite to the moving direction of the splitter.

2. The support structure as in claim 1, wherein the ejecting device comprises an operation lever for a remote operation of the splitter for the movement from the storage position to the ejected position.

3. The support structure as in claim 1, wherein:

the splitter has an engaging hole engageable with the engaging member; and the engaging member does not engage the engaging hole during the movement of the splitter between the operational position and the ejected position.

4. The support structure as in claim 3, wherein the biasing device is a tension spring connected between the engaging member and the guide device.

5. The support structure as in claim 1, wherein the splitter moves between the operational position and the storage position within a plane parallel to the splitter.

6. A cutting tool comprising:

a table having an upper surface;

a cutting blade constructed to cut a workpiece placed on the upper surface of the table;

a splitter proximate the cutting blade and constructed to enter a kerf of the workpiece formed by the cutting blade, the splitter being movable between a first position and a second position relative to the table, and the splitter being movable between the first position and the second position within a plane that is parallel to the splitter;

a lock device constructed to lock and unlock the splitter at the first position;

a moving device constructed to automatically move the splitter from the first position to the second position upon unlocking of the splitter at the first position by the lock device, the moving device comprising a first biasing device arranged and constructed to apply a biasing force to the splitter to move the splitter from the first position to the second position; and an engaging device coupled to the first biasing device and arranged and constructed to engage and disengage the splitter, so that the biasing force is applied to the splitter when the engaging device engages the splitter, wherein the engaging device can engage the splitter as the splitter moves from the second position to the first position and the engaging device can disengage the splitter as the splitter moves from the first position to the second position by the biasing force of the first biasing device.

7. The cutting tool as in claim 6, wherein:

the first biasing device comprises a tension spring; and the engaging device comprises an engaging member pivotally connected to the tension spring.

8. The cutting tool as in claim 6, further comprising a second biasing device constructed to bias the engaging device in an engaging direction with the splitter.

9. The cutting tool as in claim 6, further comprising an operation device coupled to the lock device, wherein the operation device includes an operation member operable at a position remote from the lock device.

10. The cutting tool as in claim 6, wherein:

substantially the entire splitter is positioned below the upper surface of the table when the splitter is in the first position; and at least a part of the splitter extends upward from the upper surface of the table when the splitter is in the second position.

11. The cutting tool as in claim 6, wherein the first biasing device is configured to accumulate the moving force of the splitter from the second position to the first position as the biasing force in a direction opposite to the moving direction of the splitter.

* * * * *